US010183837B2

(12) United States Patent
Kusserow

(10) Patent No.: US 10,183,837 B2
(45) Date of Patent: Jan. 22, 2019

(54) COMMUNICATION METHOD FOR AN ELEVATOR SYSTEM BETWEEN A UNIT ON AN ELEVATOR CAR AND A REMOTE SERVICE CENTER

(71) Applicant: Inventio AG, Hergiswil NW (CH)

(72) Inventor: Martin Kusserow, Lucerne (CH)

(73) Assignee: INVENTIO AG, Hergiswil (CH)

( * ) Notice: Subject to any disclaimer, the term of this patent is extended or adjusted under 35 U.S.C. 154(b) by 382 days.

(21) Appl. No.: 14/910,024

(22) PCT Filed: Jul. 31, 2014

(86) PCT No.: PCT/EP2014/066526

§ 371 (c)(1),
(2) Date: Feb. 4, 2016

(87) PCT Pub. No.: WO2015/018741

PCT Pub. Date: Feb. 12, 2015

(65) Prior Publication Data

US 2016/0176678 A1 Jun. 23, 2016

(30) Foreign Application Priority Data

Aug. 9, 2013 (EP) ..... 13179846

(51) Int. Cl.

| | |
|---|---|
| ***B66B 1/28*** | (2006.01) |
| ***B66B 1/34*** | (2006.01) |
| ***B66B 5/00*** | (2006.01) |

(52) U.S. Cl.

CPC ..... *B66B 1/3461* (2013.01); *B66B 5/0018* (2013.01)

(58) Field of Classification Search

CPC ..... B66B 1/3461; B66B 5/0018

(Continued)

(56) References Cited

U.S. PATENT DOCUMENTS 4,697,243 A * 9/1987 Moore ..... B66B 5/0087 178/4.1 B
5,832,363 A * 11/1998 Moriya ..... B66B 1/34 455/11.1

(Continued)

FOREIGN PATENT DOCUMENTS

| | | |
|---|---|---|
| CN | 1509252 A | 6/2004 |
| EP | 1282578 A1 | 2/2003 |

(Continued)

*Primary Examiner* — Anthony Salata

(74) *Attorney, Agent, or Firm* — William J. Clemens; Shumaker, Loop & Kendrick, LLP

(57) ABSTRACT

A method for the exchange of data between one unit of an elevator system and a monitoring unit of a service center locationally remote from the elevator system, wherein, via a first communication network, the one unit is connected with a communication unit arranged on, or in, an elevator car that travels vertically in an elevator hoistway, and wherein the data that are transmitted by the one unit are transmitted to the communication unit and stored there. A mobile-communication end-device brought into the elevator car by an elevator passenger is connected, via a second wireless communication network, with the communication unit and the stored data are transmitted by the communication unit to the end-device, and stored in the latter. When the elevator car is exited by the elevator passenger with the end-device, the stored data are transmitted from the end-device via a public mobile-communication network to the monitoring unit.

13 Claims, 3 Drawing Sheets

(58) Field of Classification Search
USPC ..... 187/247, 380–388, 391, 393, 394
See application file for complete search history.

(56) References Cited

U.S. PATENT DOCUMENTS 6,446,761 B1 9/2002 Motoyama et al.
6,601,679 B2 * 8/2003 Crenella ..... B66B 1/34 187/247
6,863,161 B2 * 3/2005 Mearns ..... B66B 5/0006 187/247
7,004,289 B2 * 2/2006 Shrum, III ..... B66B 5/0037 187/393
7,073,633 B2 * 7/2006 Weinberger ..... B66B 5/0025 187/247
7,789,204 B2 * 9/2010 Amano ..... B66B 5/0025 187/247
8,028,807 B2 * 10/2011 Deplazes ..... B66B 5/0025 187/247
8,540,057 B2 * 9/2013 Schuster ..... B66B 1/34 187/247
8,678,143 B2 * 3/2014 Bunter ..... B66B 5/0025 187/247
9,403,663 B2 * 8/2016 Dellarippa ..... B66B 1/34
9,580,276 B2 * 2/2017 Toutaoui ..... B66B 1/3461
2006/0108181 A1 5/2006 Bacellar
2012/0175196 A1 7/2012 Hughes et al.
2016/0185568 A1 * 6/2016 Kusserow ..... B66B 1/3446 340/3.31

FOREIGN PATENT DOCUMENTS

EP 1415947 A1 5/2004
JP 2005015176 A 1/2005
JP 2005060010 A 3/2005
JP 2009215060 A 9/2009

* cited by examiner

COMMUNICATION METHOD FOR AN ELEVATOR SYSTEM BETWEEN A UNIT ON AN ELEVATOR CAR AND A REMOTE SERVICE CENTER

FIELD

The invention relates to a method for the exchange of data between at least one unit of an elevator system and a monitoring unit of a service center which is remote from the elevator system, wherein, used in the elevator system is an elevator car that travels in the elevator hoistway, wherein the at-least one unit is connected through a first communication network with a first communication unit which is arranged on, or in, the elevator car, in which first communication unit the data that are transmitted from the at-least one unit are stored, and wherein the data from the first communication unit are transmitted through a public mobile-communication network to the monitoring unit of the service center that is remote from the elevator system.

BACKGROUND

U.S. Pat. No. 6,446,761 B1 describes an elevator system in which data are wirelessly transmitted between an elevator control, an elevator car, a counterweight, and a plurality of elevator operating units that are arranged on the floors. For this purpose, mounted on the said elevator components are terminals with transmitter-receiver units, which have a relatively short range. For the purpose of transmitting data between transmitter-receiver units of elevator components, whose distance from each other is greater than the range, the data are transmitted from the transmitting transmitter-receiver unit to the receiving transmitter-receiver unit via intermediately arranged transmitter-receiver units. For communication with the elevator car that is moving in the elevator hoistway, in each case, depending on the known elevator position, a transmitter-receiver unit that is momentarily near to the elevator car is selected as intermediate station.

US2006/0108181A1 describes an elevator system with an elevator control and an elevator control unit on each floor and in the elevator car. The elevator control units and also the elevator control are equipped with a Piconet module, the Piconet modules forming a wireless communication network through which each Piconet module can receive information that is transmitted from all other Piconet modules and transmit it to all others. The communication network enables the transmission of information over a series of several Piconet modules, which means over distances that exceed the range of a single Piconet module. The Piconet communication module also makes it possible for passengers, by means of a remote-control device with Piconet network, to enter a car call, and for a maintenance specialist, for example, by means of a personal digital assistant (PDA) with special module, to test and influence the elevator control by remote control.

US2012/0175196A1 describes a method for remote access to a plurality of subsystems of an elevator control system. The method comprises, in particular, method steps which, at the beginning of a remote access, serve to detect whether a service device is locally already connected with the elevator control and active.

EP 1415947 A1 discloses a device for the remote maintenance and monitoring of an elevator system with at least one input for the detection of first signals from an elevator control, and/or from a sensor with at least one output of second signals to a telecommunication network, and with at least one processor and a data storage, wherein, stored in the data storage, is a set of remote-maintenance functions, and wherein one of these remote-maintenance functions can be activated. Data from a sensor, or from the elevator control, are permanently transmitted through the telecommunication network to a service center.

EP 1282578 B1 describes a possibility for operating an elevator by means of a radio-telephone as operating unit. Therein, the radio-telephone, which is also referred to as a mobile phone or communication end-device, contains a keypad, which is intended as data-input unit, and a display element, also referred to as a display, which is intended as data-output unit. The mobile phone can communicate wirelessly with a mobile-communication network, wherein speech and/or data can be transmitted. For the purpose of transmitting speech and/or data, the mobile-communication network can enter into communication with further mobile telephones or with a terminal. The terminal consists of a computer system, referred to as a server, which has access to a memory with elevator-specific and/or general information. By means of an interface, the server is also connected with the elevator system. Mobile phone, mobile-communication network, and terminal form a human/machine interface between the user and the elevator system.

A disadvantage of such a method is that, for the wireless communication between a communication unit that is arranged on, or in, the elevator car of the elevator system, and a base station of the public mobile-communication network, a large communication range and a high antenna power are necessary, in order that a certain communication can be assured. On the one hand, this results in a relatively high energy consumption, and on the other hand, there is a substantial risk that the functioning of electronic instruments of the elevator system is impaired by electromagnetic fields. Frequently, complex network protocols are used which, because of safety requirements, generate a high traffic load when transmitting data. Although, by this means, a certain and reliable connection can be established, and a dependable delivery of data packets, and the assurance of an error-free transmission between the units that are involved in the communication, can be guaranteed, on account of such network protocols the (communication) units additionally have a high energy consumption.

SUMMARY

The task of the invention is to propose a simple, energy-efficient communication method for the communication between an elevator car of an elevator system and a service center which is locationally remote from the elevator system, which communication method causes electromagnetic interferences (electrosmog) which are as small as possible.

A core of the invention, or the solution of the task, is to be seen in that, in the method for the exchange of data between at least one unit of an elevator system and a monitoring unit of a service center, which is locationally remote from the elevator car, at least one data- or signal-generating unit of the elevator system is connected through a first communication network with a first communication unit that is arranged on, or in, the elevator car, and the data or signals that are transmitted by the at-least one unit are stored in the first communication unit. At least one mobile-communication end-device (e.g. a smartphone), which is brought into the elevator car by an elevator passenger, is connected, via a second wireless communication network, with the first communication unit, after which, the data that are transmitted by the at-least one unit to the first communication unit, and stored there, are transmitted by the first communication unit to the mobile-communication end-device, and stored in the latter. After the elevator passenger with the mobile-communication end-device has exited the elevator car or the elevator hoistway respectively, the stored data are transmitted from the mobile-communication end-device via a public mobile-communication network to the monitoring unit that is locationally remote from the elevator system.

In a possible embodiment of the method, depending on at least one rule, the data are transmitted by the first communication unit to the mobile-communication end-device and stored there.

In a further possible embodiment of the method, the data that are stored in the mobile-communication end-device are transmitted from the mobile-communication end-device over a public mobile-communication network, depending on at least one further rule, to the monitoring unit of the service center.

Expediently, used as at least one further rule can be a previously defined data volume, a priority of the data, a safety-requirement criterion, a clock time, a time delay, a signal strength, a transmission time, an authentication or authorization of the mobile-communication end-device, a verification that the mobile-communication end-device contains a specific program, a dependence on an inquiry of the monitoring unit of the service center, etc.

In one of the possible embodiments of the method, as first communication network, in other words, the communication connection between the at-least one unit and the first communication unit, a wired, or a wireless, communication network can be used.

In a further possible embodiment of the method, as mobile-communication end-device, for example a computer, a tablet computer (tablet PC), a mobile-communication end-device, an intelligent mobile-communication end-device (smartphone), etc., can be used, wherein the mobile-communication end-device is connected with the first communication unit through a wireless second communication network.

In a further possible embodiment of the method, the mobile-communication end-device can have at least a program (e.g. an app) for storing, transmitting, managing, etc., the data.

Expediently, the at-least one unit can be embodied as sensor unit, elevator control unit, actuator, elevator operating unit, computer, mobile-communication end-device, tablet computer, etc.

In a possible embodiment of the method, the data can be transmitted from the at-least one unit, for example a sensor unit, through a wireless first communication network to the first communication unit, when the elevator car with the first communication unit travels past the sensor unit or is in its proximity. In this case, the communication range of the wireless first communication network can be so selected that it approximately matches the cross-section of the elevator hoistway. This achieves that, for the transmission of the data from the at-least one unit to the first communication unit, the wireless first communication network can be embodied with relatively short communication range, i.e. with low power requirement.

In a further possible embodiment of the method, as sensor unit or actuator, for example an acceleration sensor, a temperature sensor, an air-pressure sensor, a current sensor, a force sensor, a magnetic-field sensor, a gyroscope, a voltage sensor, a light sensor, an air-humidity sensor, a door-contact unit, a safety unit, a weight sensor, a velocity sensor, a position sensor, a switching unit, etc. can be used.

The second communication network can be embodied as, for example, near-field communication, Bluetooth connection, wireless local area network (WLAN), etc. The method can, in principle, be used bidirectionally. So, for example, mobile-communication end-devices that are registered in the monitoring unit of the service center could be used to transmit data from the monitoring unit to the elevator system. For this purpose, data from the monitoring unit are transmitted to the mobile-communication end-device and, upon establishment of a connection between the mobile-communication end-device and the first communication unit, these data are then transmitted further to a unit, e.g. to a sensor, or to the elevator control unit of the elevator system.

A significant advantage of the method according to the invention is that, as possibility for the transmission of data from an elevator system to a monitoring unit of a service center, a mobile-communication end-device can be used. This has, in particular, the advantage, that also the communication range of the second wireless communication network can be limited to the area of the elevator car, which reduces the energy consumption of the second wireless communication network, whose electromagnetic interference effect and whose manufacturing costs are reduced to a minimum.

A further advantage of the method according to the invention is to be seen in that the data can be transmitted to a monitoring unit of a service center even though no direct communication connection between a communication unit of the elevator system and the monitoring unit exists. Frequently, as a result of building-related screening, no wireless connection between a communication unit that is arranged in an elevator hoistway and a monitoring unit that is locationally remote from the elevator hoistway can be realized, because no connection from the communication unit to a base station of a public wireless communication network can be established. With the method according to the invention, at least with a time delay, this is possible.

In one of the possible embodiments of the method for the exchange of data between at least one unit of an elevator system and a locationally remote monitoring unit of a service center, in the elevator system an elevator car is used which travels vertically in the elevator hoistway. Therein, the at-least one unit is connected through a first communication network with a communication unit which is arranged on, or in, the elevator car, and at least one mobile-communication end-device in the elevator car is connected through a second wireless communication network with the first communication unit. Further, data from the at-least one unit are transmitted to the first communication unit and stored there, after which, depending on at least one rule, the data are transmitted from the first communication unit to the mobile-communication end-device and stored there, and after which, depending on at least one further rule, the stored data are transmitted from the mobile-communication end-device through a public mobile-communication network to the monitoring unit.

DESCRIPTION OF THE DRAWINGS

The invention is explained in greater detail below by reference to an exemplary embodiment, which is illustrated in the figures. Shown are in FIG. 1*a* is a first part of a schematic representation of an elevator system according to the invention.

DETAILED DESCRIPTION

Figure 1A:
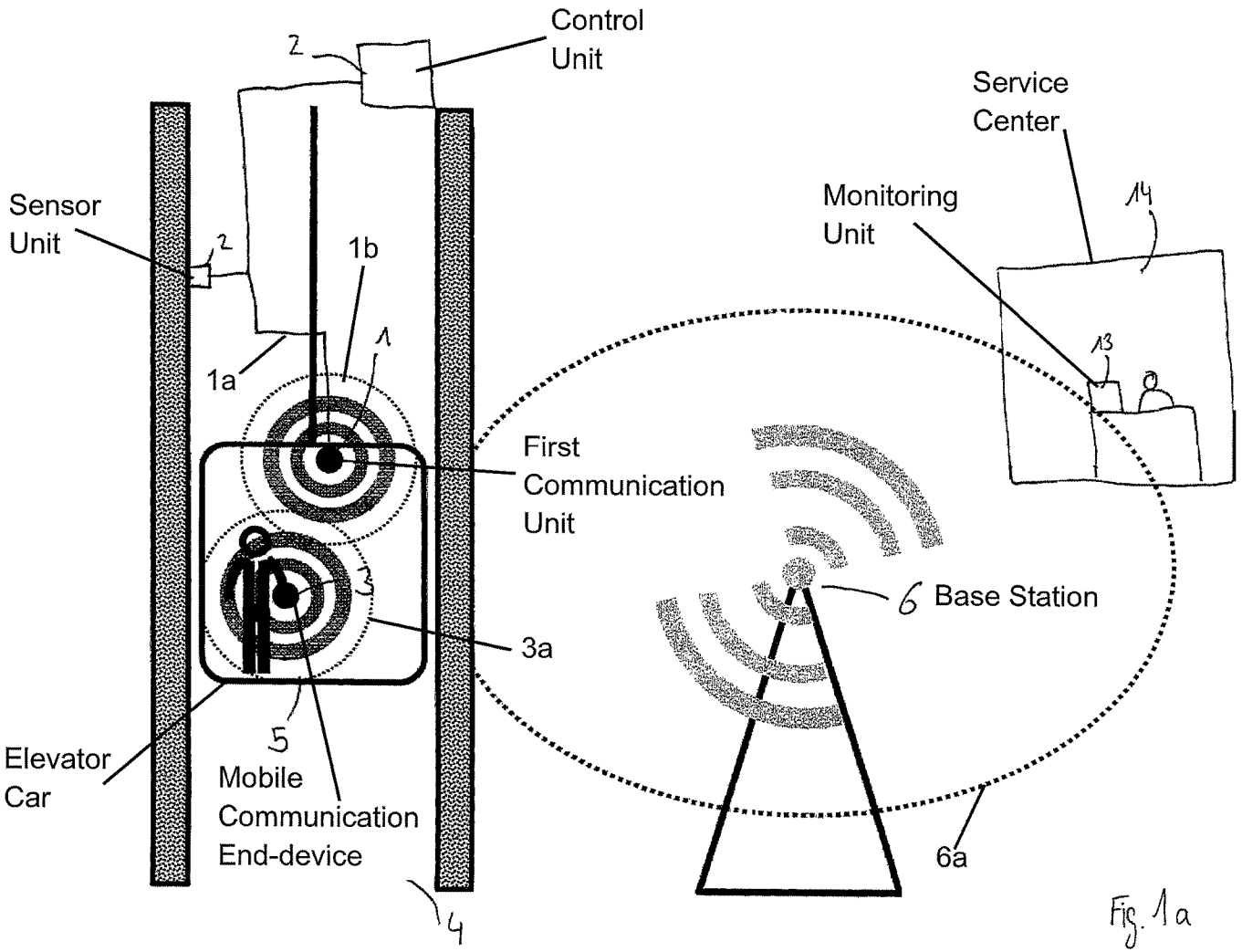
FIG. 1*b* is a second part of the schematic representation of an elevator system according to the invention.

FIG. 1*a* shows a first part of a schematic representation of an elevator system according to the invention. In an elevator hoistway 4 of an elevator system, an elevator car 5 travels vertically between not-shown floors of a building.

Arranged on, or in, the elevator car 5 is a first communication unit 1, which, through a wired 1*a* or wireless 1*b* communication network, is connected with at least one unit 2 of the elevator system. Shown in this example as at least one unit 2 are a sensor unit in the elevator hoistway 4 and an elevator control unit of the elevator system. However, also conceivable as at least one unit 2 are also actuators, elevator control units, computers, etc., which are not shown here. The at-least one unit 2 could also be arranged in, or on, the elevator car 5. In this case, the first communication unit 1 could also be integrated in the unit 2.

The elevator control unit 2 can be arranged in the elevator hoistway 4 or in a machine room of the elevator system.

As sensor unit or actuator, an acceleration sensor, a temperature sensor, an air-pressure sensor, a current sensor, a voltage sensor, a light sensor, an air-humidity sensor, a door-contact unit, a safety unit, a weight sensor, a velocity sensor, a position sensor, a switching unit, etc., for example, can be used.

Present in the elevator car 5 is a passenger with a mobile-communication end-device 3. Used as mobile-communication end-device 3 can be a mobile-communication end-device, an intelligent mobile-communication end-device, a computer, etc. Through a second wireless communication network 3*a*, the mobile-communication end-device 3 is connected with the first communication unit 1. The second wireless communication network can be embodied as a Bluetooth network, WLAN network, near-field communication, etc. The mobile-communication end-device 3 can contain a program, for example a so-called app, which manages or regulates the storage and transmission of the data. Such a program can also serve to control the elevator system or to receive elevator-relevant information.

Shown schematically outside the elevator system is a base station 6 of a public mobile-communication network. Indicated with the dashed line 6*a* is the communication range of the base station 6. Also clear therefrom is that, inside the elevator hoistway 5, the public mobile-communication system is not available, i.e. that the mobile-communication end-device 3 has no communication connection to the base station 6. This means that the mobile-communication end-device 3 must leave the elevator system, or the elevator car 5 in the elevator hoistway 4, for it (3) to be able to establish a connection to the public mobile-communication network through the base station 6. Any public mobile-communication network can be used. So, in principle, any packet-transmitting mobile-communication network, for example, a General Packet Radio Service (GPRS) network, a 3G Universal Mobile Telecommunication System (UMTS) standard network, an Enhanced Data Rates for GSM Evolution (EDGE) Technology network, a 4G network according to the Long Term Evolution (LTE) Standard, etc., can be used.

The data from the at-least one unit 2 are transmitted through the first communication network 1*a*, 1*b* to the first communication unit 1 and preferably stored there. For this purpose, the first communication unit 1 contains at least a storage unit and a communication module. In principle, the data can be of any type. Hence they can be, for example, values, parameters, sensor values, messages, alarm signals, statistical analyses of values, safety-relevant information, maintenance-relevant information, information about the status or state of elevator components, messages regarding the requirement for a maintenance service, etc.

Depending on at least one rule, the first communication unit 1 transmits the data over the second wireless-communication network 3*a* to at least one mobile-communication end-device 3 of a passenger. The mobile-communication end-device 3 stores the data and, depending on at least one further rule, transmits the data through at least one base station(s) 6 of the public mobile-communication network 6*a* to a monitoring unit 13 of a service center 14. The transmission generally takes place when the mobile-communication end-device 3 leaves the elevator car 5, and hence the elevator hoistway 4 of the elevator system, with the passenger, and can establish a stable connection with the public mobile-communication network 6*a* through the base station 6.

The at-least one rule and the at-least one further rule can be various. So, for example, a certain data volume for the transmission of the data, or a priority of the data, can be defined. Also safety-requirement criteria, a clock-time, a time-delay of the transmission, a signal-strength of the wireless connection, and/or a transmission time can be used. But also criteria such as the mobile-communication provider, the authentication and/or authorization of the user of the mobile-communication end-device 3, etc. can be used as at least one, or as at least one further, rule.

Based on the at-least one rule, the first communication unit 1 could, for example, initially store the data in its storage unit and only transmit them to the mobile-communication end-device 3 when the mobile-communication end-device 3 has set, and written to the first communication unit 1 (or to another unit, for example the elevator control unit), a predefined mobile-communication provider as standard provider. The data can then be transmitted from the mobile-communication end-device 3 to the monitoring unit 13 of the service center 14 when, according to the at-least one further rule, the mobile-communication end-device 3—normally after leaving the elevator car or the building—has established a connection with the standard provider.

Figure 1B:
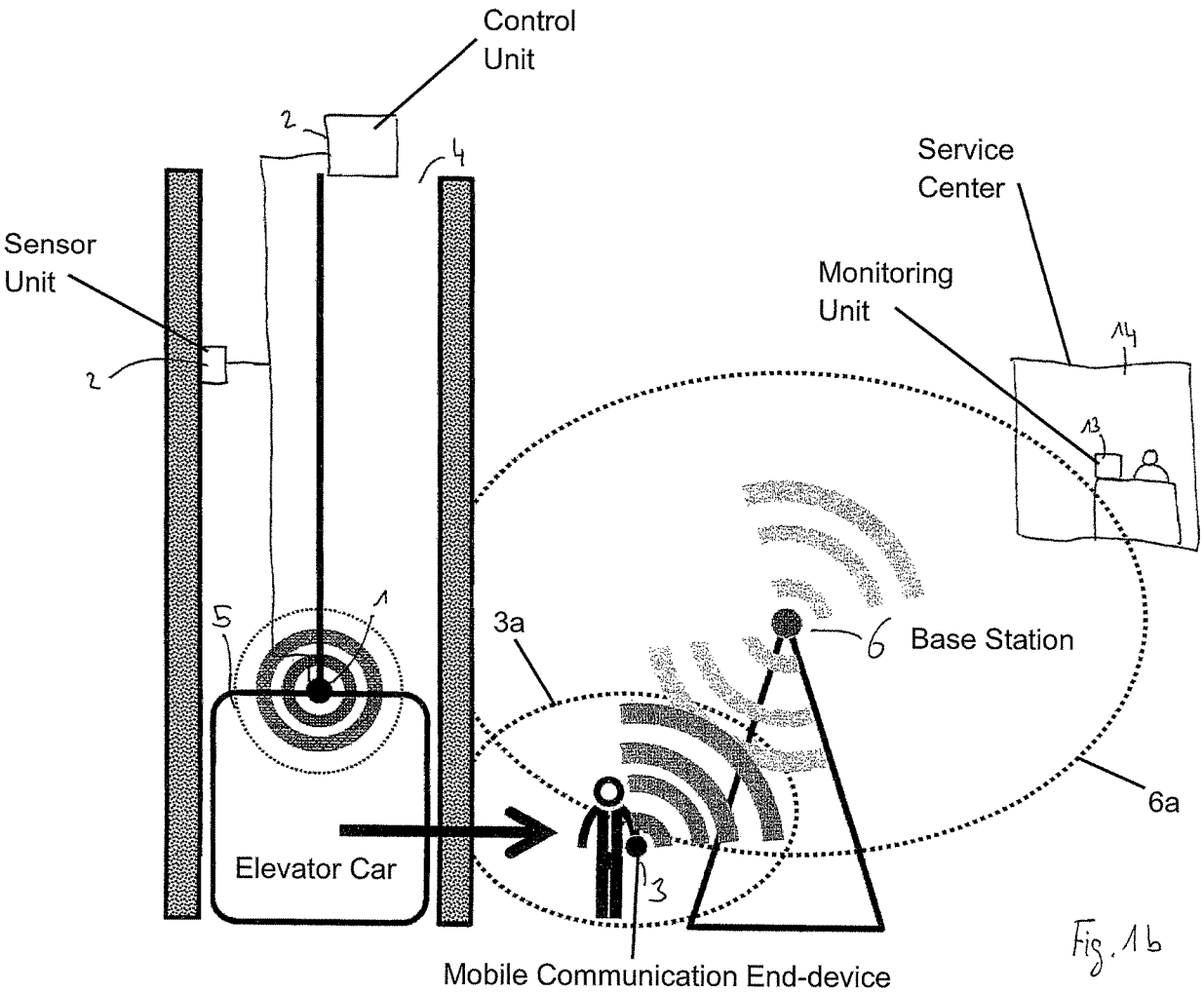

FIG. 1*b* shows a second part of the schematic illustration of an elevator system according to the invention. As already described in connection with FIG. 1*a*,—after it has, together with the passenger, left the elevator car 5 and hence the elevator hoistway 4 of the elevator system,—through the base station 6, the mobile-communication end-device 3 establishes a connection with the public wireless mobile-communication network 6*a* and, depending on the at-least one further rule, transmits the data to the monitoring unit 13 of the service center 14, which is connected with the mobile-communication network.

Figure 2:
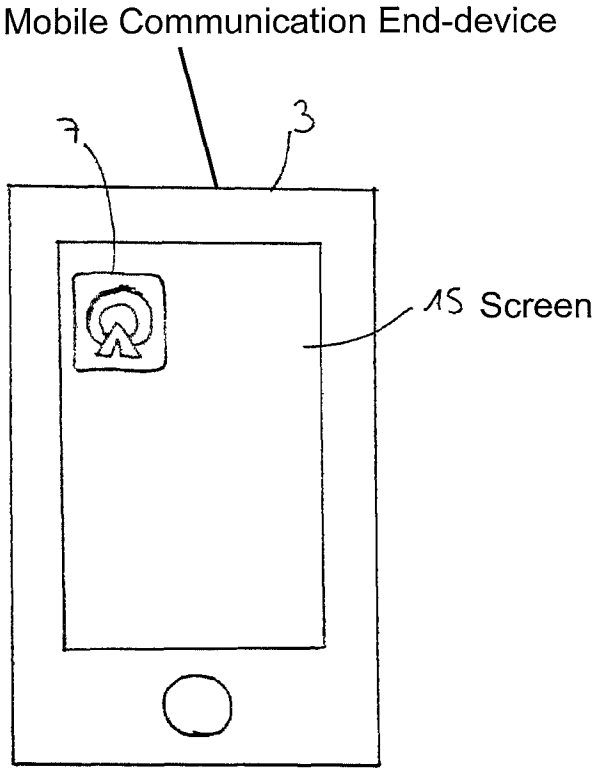
FIG. 2 is an example of a mobile-communication end-device.

FIG. 2 shows an example of a mobile-communication end-device 3. As mobile-communication end-device 3 in this example, use of an intelligent mobile-communication end-device—a smartphone—is foreseen. Self-evidently, instead of a smartphone, a computer, a mobile-communication end-device, a tablet computer (tablet PC=personal computer), etc. can also be used. The mobile-communication end-device 3 has a screen (display) 15 and at least a—not-shown—storage unit, a communication module (transceiver) and a processing unit. Contained in the mobile-communication end-device 3 is a program 7—an app—for the performance of the method according to FIGS. 1*a* and 1*b*. The display 15 can be embodied as a touch-sensitive screen. The program 7 can serve to store, transmit, and manage the data that are to be transmitted to the monitoring unit 13. The program 7 is, for example, indicated on the display 15 by a symbol (icon). Activation of the program 7 can take place by touching the icon, or the program is activated when the mobile-communication end-device 3 is started, or upon installation of the program 7.

Figure 3:
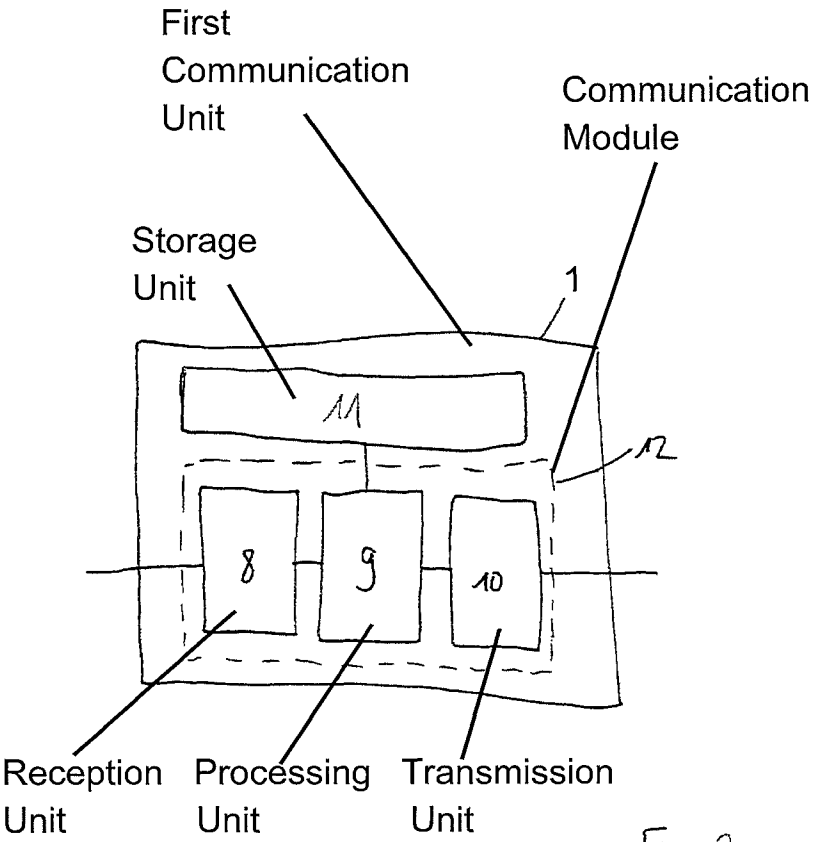
FIG. 3 is a simplified representation of a first communication unit.

FIG. 3 shows a simplified diagram of a first communication unit 1 for execution of the method according to FIGS. 1*a* and 1*b*. For this purpose, the first communication unit 1 contains at least a storage unit 11 and at least a communication module 12. The communication module 12 can contain a reception unit 8, a processing unit 9, and a transmission unit 10.

The first communication unit 1 can be embodied as a separate unit or integrated in the at-least one unit 2 of the elevator system, for example in an elevator control unit, an elevator operating unit, a sensor unit, etc. Preferably, the first communication unit 1 is arranged in, or on, the elevator car 5. In this case, the first communication unit 1 can receive the data from the at-least one unit 2—for example, from a sensor unit with short communication range that is installed in the elevator hoistway—through the wireless first communication network, when the elevator car 5 travels past the at-least one unit 2 (e.g. sensor unit) or is in its proximity.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. A method for the exchange of data between at least one unit of an elevator system and a monitoring unit of a service center that is locationally remote from the elevator system, wherein the elevator system includes an elevator car that runs in an elevator hoistway, a first wireless communication network that connects the at-least one unit with a first communication unit arranged on, or in, the elevator car, and wherein data transmitted from the at-least one unit are stored in the first communication unit, comprising the steps of:

a mobile-communication end-device, which is brought into the elevator car by an elevator passenger, is connected, via a second wireless communication network, with the first communication unit;

the data that are transmitted by the at-least one unit to the first communication unit, and stored there, are transmitted by the first communication unit to the mobile-communication end-device and stored therein; and after the elevator car is exited by the elevator passenger with the mobile-communication end-device, the stored data are transmitted by the mobile-communication end-device, via a public mobile-communication network, to the monitoring unit that is locationally remote from the elevator system, wherein the end-device is not in communication with the public mobile-communication network when the end-device is in the elevator car.

2. The method according to claim 1 wherein, depending on at least one rule, the data are transmitted by the first communication unit to the mobile-communication end-device and stored there.

3. The method according to claim 1 wherein the at least one rule is based on at least one of a previously defined data volume, a priority of the data, a safety-requirement criterion, a time delay, a signal strength and a transmission time.

4. The method according to claim 2 wherein, depending on at least one further rule, the stored data are transmitted by the mobile-communication end-device via the public mobile-communication network to the monitoring unit.

5. The method according to claim 4 wherein the at least one further rule is based on at least one of a previously defined data volume, a priority of the data, a safety-requirement criterion, a time delay, a signal strength and a transmission time.

6. The method according to claim 1 wherein the first communication network is a wireless communication network or a wired communication network.

7. The method according to claim 1 wherein the mobile-communication end-device is one of a computer, a tablet computer, and an intelligent mobile-communication end-device.

8. The method according to claim 7 wherein the mobile-communication end-device includes at least one program for storing, managing, and transmitting the data.

9. The method according to claim 1 wherein the at least one unit is a sensor unit or an elevator control unit.

10. The method according to claim 9 wherein the data are transmitted by the sensor unit when the elevator car with the first communication unit is caused to travel past the sensor unit or is in proximity to the sensor unit.

11. The method according to claim 9 wherein a communication range of the sensor unit matches a cross section of the elevator hoistway.

12. The method according to claim 9 wherein the sensor unit is one of an acceleration sensor, a temperature sensor, an air-pressure sensor, a current sensor, a voltage sensor, a light sensor, an air-humidity sensor, a door-contact unit, a safety unit, a weight sensor, a velocity sensor and a position sensor.

13. The method according to claim 1 wherein the first communication unit includes a data storage unit connected to a data communication module.

* * * * *